US007261344B1

(12) United States Patent
Drake, Jr. et al.

(10) Patent No.: US 7,261,344 B1
(45) Date of Patent: Aug. 28, 2007

(54) DOORMAN

(76) Inventors: William Drake, Jr., 608 Second St., Dunellen, NJ (US) 08812; Kenneth Hill, 608 Second St., Dunellen, NJ (US) 08812

( * ) Notice: Subject to any disclaimer, the term of this patent is extended or adjusted under 35 U.S.C. 154(b) by 156 days.

(21) Appl. No.: 11/114,788

(22) Filed: Apr. 25, 2005

(51) Int. Cl.
*E05C 17/44* (2006.01)

(52) U.S. Cl. ..... 292/343; 292/342; 292/339

(58) Field of Classification Search ..... 292/343, 292/342, DIG. 15, 342 X, 339 X; 16/82, 16/86 A, 86 B; D8/300, 303, 307, 311
See application file for complete search history.

(56) References Cited

U.S. PATENT DOCUMENTS

| | | | | | |
|---|---|---|---|---|---|
| 937,183 | A | | 10/1909 | Rounds | |
| 1,939,402 | A | * | 12/1933 | Moser | 292/343 |
| 2,376,117 | A | * | 5/1945 | Bright et al. | 292/343 |
| D219,362 | S | * | 12/1970 | Snyder | D8/339 |
| 4,098,442 | A | * | 7/1978 | Moore | 294/141 |
| 5,217,269 | A | * | 6/1993 | Wiltberger | 292/343 |
| D353,536 | S | * | 12/1994 | Tucker | D8/402 |
| D387,659 | S | * | 12/1997 | Harrick et al. | D8/402 |
| 5,791,711 | A | | 8/1998 | Tobias | |
| 5,997,063 | A | | 12/1999 | McCraw | |
| 6,557,915 | B1 | * | 5/2003 | Duff | 292/343 |

* cited by examiner

*Primary Examiner*—Brian E. Glessner
*Assistant Examiner*—Mark Williams

(57) ABSTRACT

An apparatus for assisting handicapped people in opening doors. The apparatus is used primarily for individuals in wheelchairs, who typically have difficulty in opening doors. The apparatus has a long shaft with two ends, and has a handle attached to one end of the shaft. The other end of the shaft has both a wedge and a pull pin attached to it. The wedge is used to keep an opened door in an open stage by placement underneath the door in between the bottom of the door and a ground surface. The pull pin is used for placement behind a door handle to effectively "pull open" a door.

5 Claims, 4 Drawing Sheets

DOORMAN

I. BACKGROUND OF THE INVENTION

The present invention concerns that of a new and improved apparatus for assisting handicapped people to open doors.

II. DESCRIPTION OF THE PRIOR ART

U.S. Pat. No. 5,997,063, issued to McCraw, discloses a J-hook assembly having an eye hole portion for use in transporting vehicles.

U.S. Pat. No. 5,791,711, issued to Tobias, discloses a cylindrical length of rod having a series of bends for use in pulling a cargo pallet.

U.S. Pat. No. 937,183, issued to Rounds, discloses a log grapping accessory device comprised of a shank with a driving tooth.

III. SUMMARY OF THE INVENTION

The present invention concerns that of a new and improved apparatus for assisting handicapped people in opening doors. The apparatus is used primarily for individuals in wheelchairs, who typically have difficulty in opening doors. The apparatus has a long shaft with two ends, and has a handle attached to one end of the shaft. The other end of the shaft has both a wedge and a pull pin attached to it. The wedge is used to keep an opened door in an open stage by placement underneath the door in between the bottom of the door and a ground surface. The pull pin is used for placement behind a door handle to effectively "pull open" a door.

There has thus been outlined, rather broadly, the more important features of a door opening assistance apparatus that the detailed description thereof that follows may be better understood and in order that the present contribution to the art may be better appreciated. There are, of course, additional features of the door opening assistance apparatus that will be described hereinafter and which will form the subject matter of the claims appended hereto.

In this respect, before explaining at least one embodiment of the door opening assistance apparatus in detail, it is to be understood that the door opening assistance apparatus is not limited in its application to the details of construction and to the arrangements of the components set forth in the following description or illustrated in the drawings. The door opening assistance apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present door opening assistance apparatus. It is important, therefore, that the claims be regarded as including such equivalent constructions insofar as they do not depart from the spirit and scope of the present invention.

It is therefore an object of the present invention to provide a door opening assistance apparatus which has all of the advantages of the prior art and none of the disadvantages.

It is another object of the present invention to provide a door opening assistance apparatus which may be easily and efficiently manufactured and marketed.

It is another object of the present invention to provide a door opening assistance apparatus which is of durable and reliable construction.

It is yet another object of the present invention to provide a door opening assistance apparatus which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
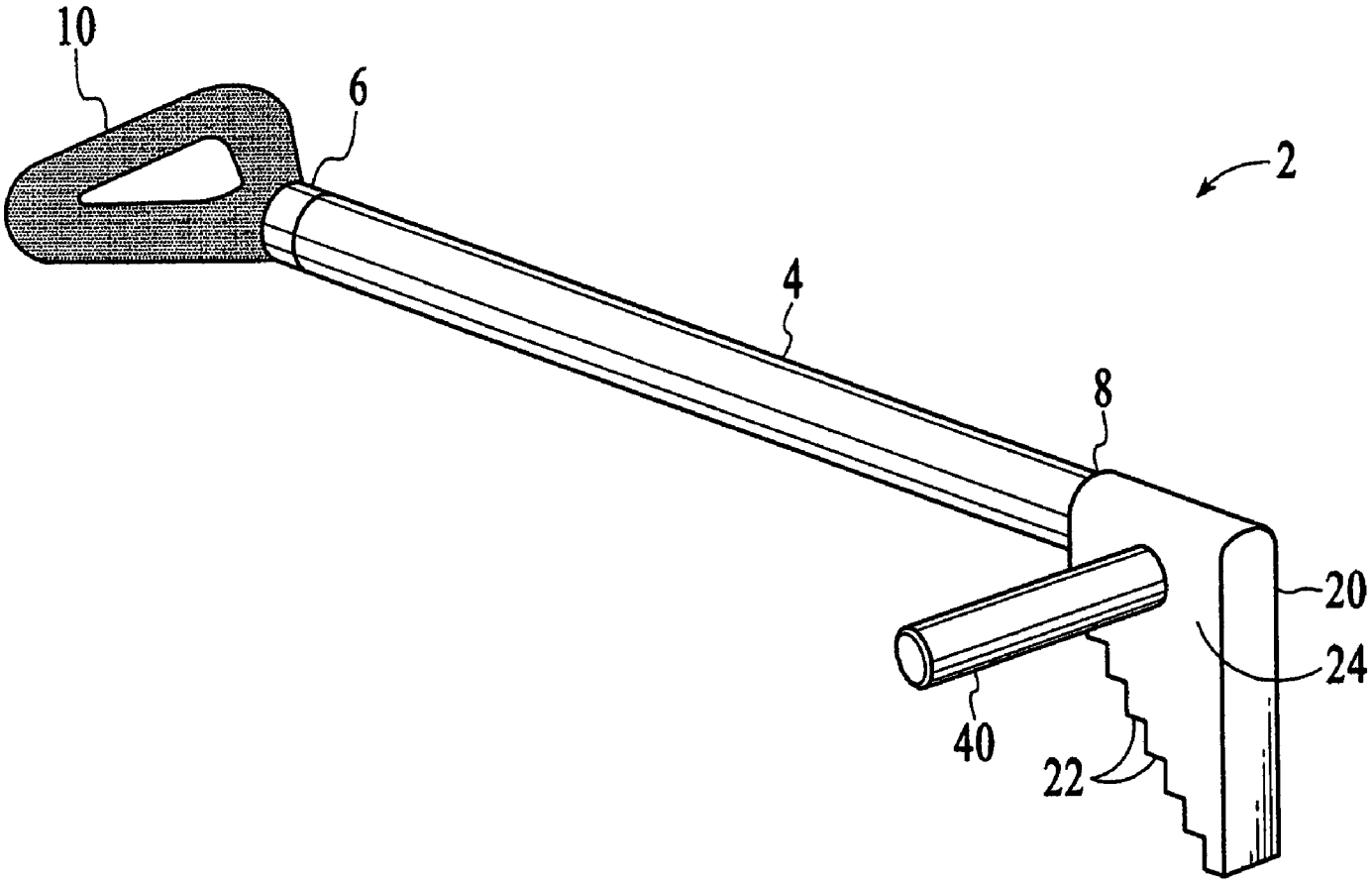
FIG. 1 shows a perspective view of the door opening assistance apparatus.

FIG. 1 shows a perspective view of the door opening assistance apparatus 2. The apparatus 2 is designed to assist handicapped people in opening doors. The apparatus is used primarily for individuals in wheelchairs, who typically have difficulty in opening doors. When such people open doors, they must be sufficiently behind the door to provide enough clearance so that when the door opens, the wheelchair will not be a hindrance or block the door from fully opening. However, when placing the wheelchair in such a situation, the door is frequently out of reach from the individual sitting in the wheelchair, thereby presenting a "Catch 22" situation for the individual sitting in the wheelchair.

The apparatus 2 comprises a long shaft 4 with two ends, a first end 6 and a second end 8, and has a handle 10 attached the first end 6 of the shaft 4. The handle 10 is shaped like a triangle and is large enough to accommodate an individual's hand. The type of handle 10 present on the apparatus 2 is frequently referred to as a "D" handle.

The second end of the apparatus 2 has a wedge 20 attached to it, with the wedge 20 having two ends, a first end and a second end, and furthermore, the wedge 20 having two sides, a first side and a second side. The first end of the wedge 20 is the end attached to the second end of the apparatus 2. From the second end of the wedge 20 to the first end of the wedge 20, the depth of the wedge 20 actually gets larger due a plurality of successive graduated notches 22 that are present. The presence of these various notches allow an individual to wedge the apparatus 2 underneath an already-open door by placing the side of the wedge 20 with the notches 22 present against the bottom of a door. The wedge 20 itself will be fabricated from a non-slip material 24 that will prevent the wedge 20 from moving about after it has been wedged against and partially underneath a door.

The apparatus 2 also has a pull pin 40 which is essentially a circular rod that sticks out approximately four to six inches from the first side of the wedge 20. The wedge pull pin 40 is used primarily when a wheelchair-bound individual needs to pull a door open to himself or herself. The pull pin 40 is best used primarily with public doors that have a flat-panel type of handle. To use the pull pin 40, an individual would essentially grasp the handle 10 and place the pull pin 40 behind the handle of a door. Then, the user would pull the handle 10 toward them, essentially opening the door. Once the door is close enough to the individual, the individual would be able to grasp the door and be able to open it enough to either travel through the door or place the wedge 20 portion of the apparatus 2 underneath the door.

Figure 2:
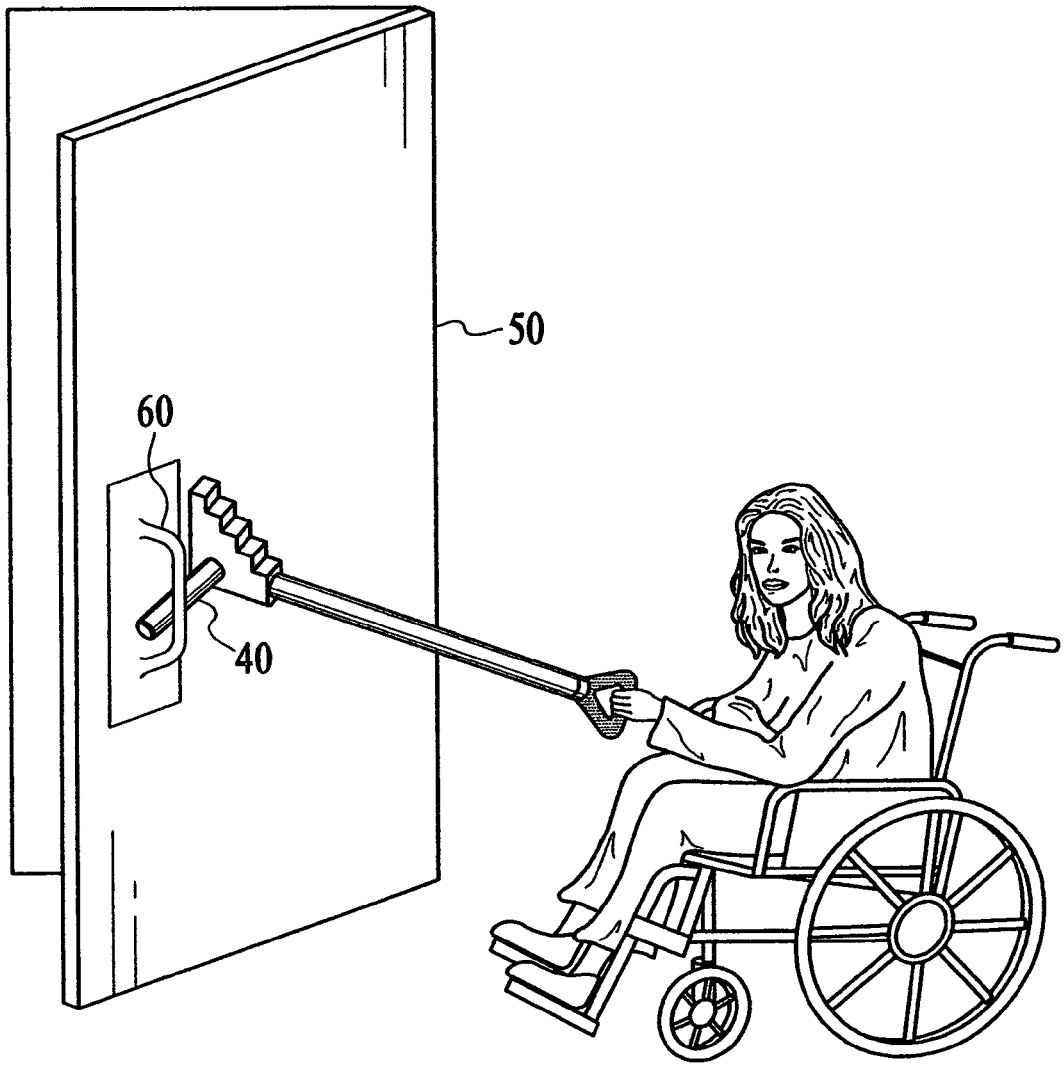
FIG. 2 shows an individual using the apparatus to open up a door by using the pull pin on the apparatus.

FIG. 2 shows an individual using the apparatus 2 to open up a door 50 by using the pull pin 40. The pull pin 40 is being placed behind a door handle 60 in order to allow the individual to pull open the door 50.

Figure 3:
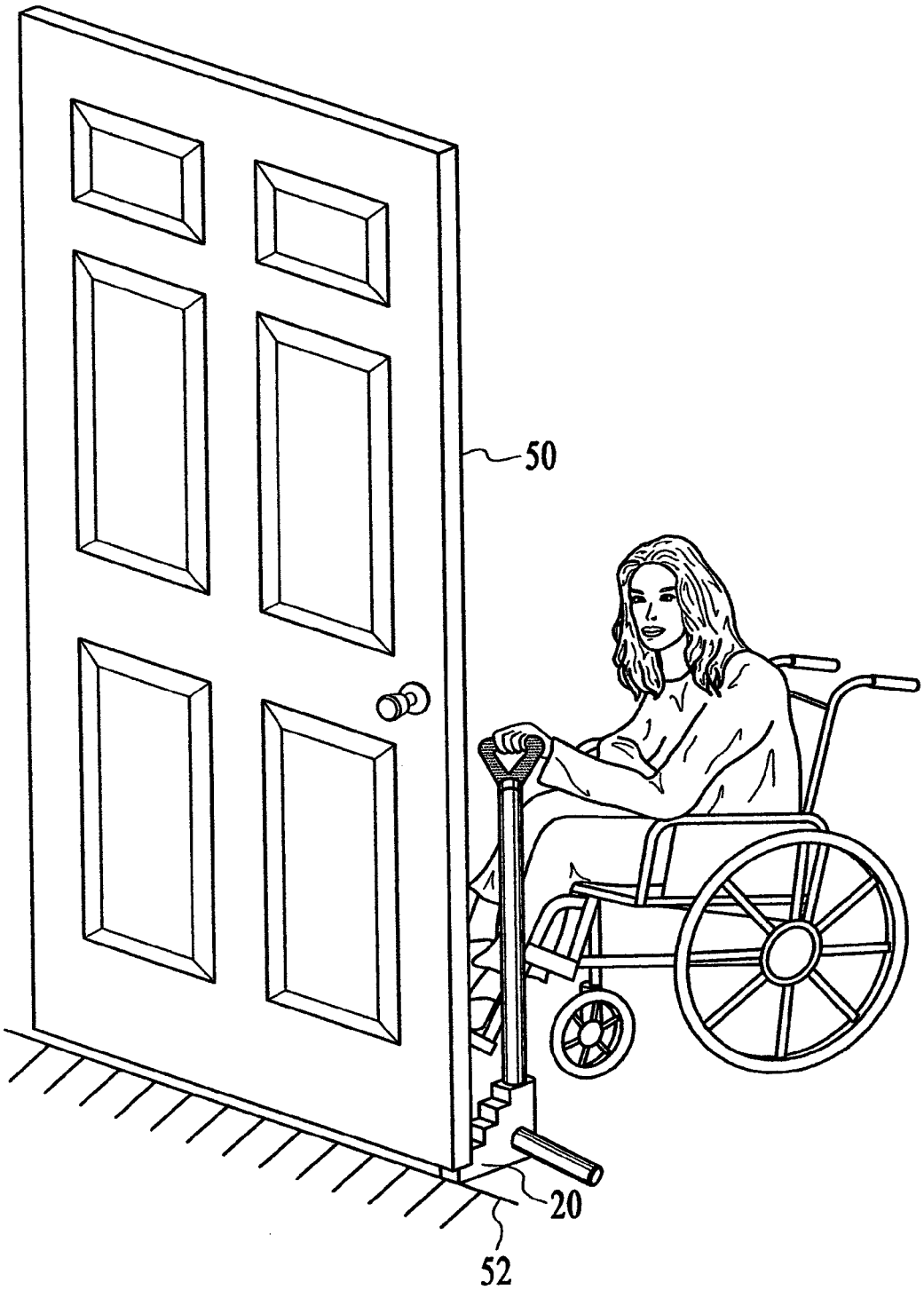
FIG. 3 shows an individual having wedged a door open by inserting the wedge of the apparatus underneath the bottom of the door in between the door and the ground surface.

FIG. 3 shows an individual having wedged a door open by inserting the wedge 20 underneath the bottom of the door 50 in between the door 50 and the ground surface 52. The door 50 can be left in this position as desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Figure 4:
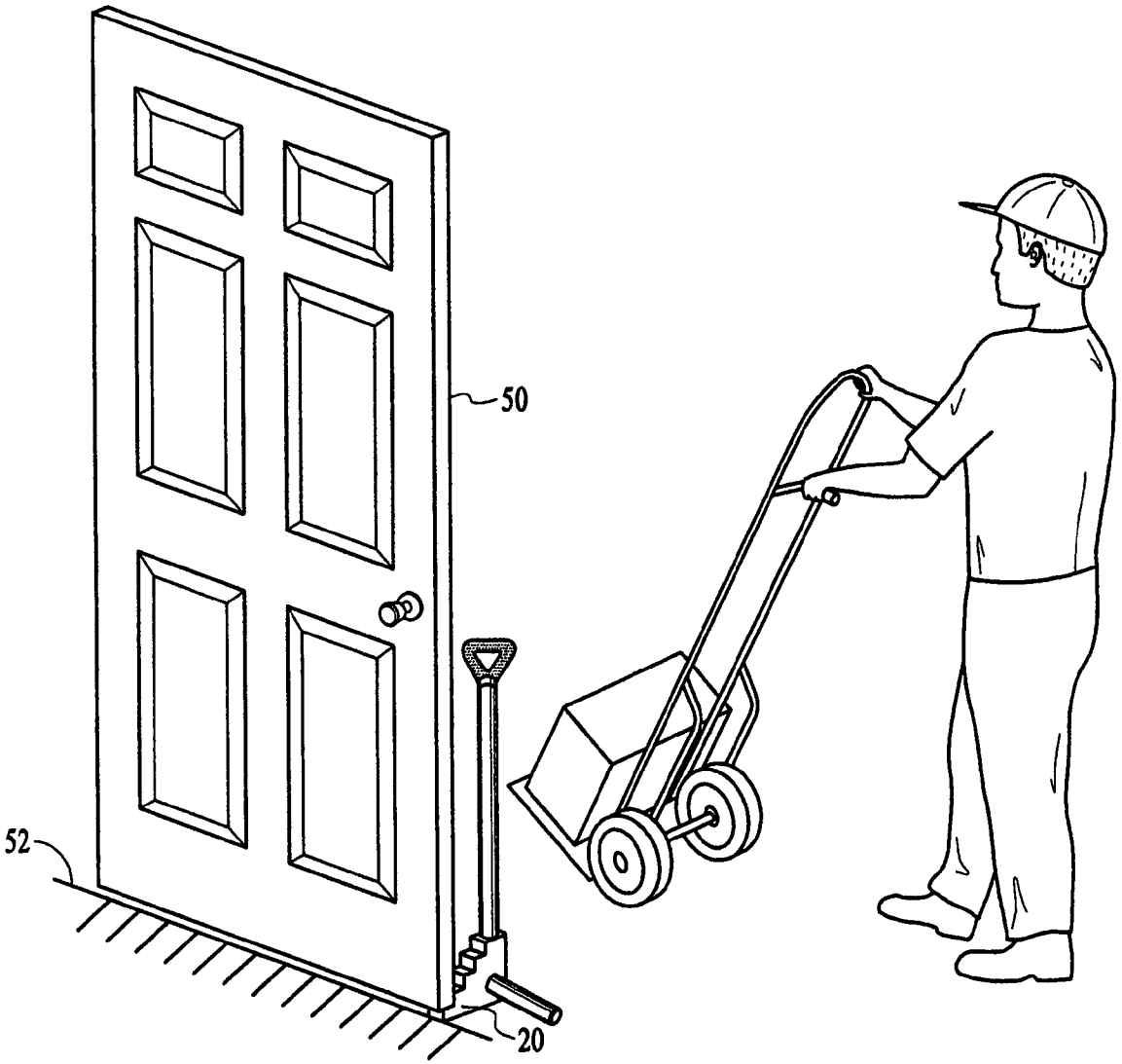
FIG. 4 shows a delivery person using the apparatus to open up a door.

FIG. 4 shows a delivery person using the apparatus to open up a door.

We claim:

1. A door opening assistance apparatus comprising:

a shaft with a first end and a second end, a handle attached to the first end of the shaft, a wedge having a top side, a bottom side, a front side, and a back side, the top side of the wedge being attached to the second end of the shaft, the wedge further having a first side and a second side, a plurality of notches formed in the front side from the bottom side to the top side, each notch having a first surface substantially parallel to the bottom side and a second surface substantially perpendicular to the first surface, a pull pin attached to the first side of the wedge and extending substantially perpendicular to the handle, wherein an individual can use the wedge to keep a door in an open state by placing the wedge underneath the door in between the bottom of the door and a ground surface, and further wherein an individual can use the pull pin attached to the first side of the wedge to pull a door open by wedging the pull pin behind a door handle associated with the door and pulling the apparatus toward the individual.

2. A door opening assistance device according to claim 1 wherein the depth of the wedge gets larger from the second end of the wedge to the first end of the wedge.

3. A door opening assistance device according to claim 1 wherein the handle is shaped like a triangle.

4. A door opening assistance device according to claim 1 wherein the handle has a "D handle" shape.

5. A door opening assistance device according to claim 1 wherein the pull pin has a round cross-sectional configuration.

* * * * *